United States Patent [19]

Ampferer

[11] Patent Number: 5,014,655

[45] Date of Patent: May 14, 1991

[54] CAMSHAFT DRIVE OF A MULTI-CYLINDER V-ENGINE

[75] Inventor: Herbert Ampferer, Sachsenheim, Fed. Rep. of Germany

[73] Assignee: Dr. Ing. h.c.F. Porsche AG, Fed. Rep. of Germany

[21] Appl. No.: 546,881

[22] Filed: Jul. 2, 1990

[30] Foreign Application Priority Data

Jul. 1, 1989 [DE] Fed. Rep. of Germany ..... 3921716

[51] Int. Cl.[5] ..... F01L 1/04; F01L 1/34; F02B 75/22

[52] U.S. Cl. ..... 123/90.31; 123/90.27

[58] Field of Search ..... 123/90.27, 90.31

[56] References Cited

U.S. PATENT DOCUMENTS

| | | | |
|---|---|---|---|
| 2,963,009 | 12/1960 | Dalza | 123/55 VS |
| 3,090,368 | 5/1963 | Buchwald | 123/90.27 |
| 3,110,195 | 11/1963 | Hanley | 74/604 |
| 4,230,074 | 10/1980 | Ichikawa et al. | 123/90.31 |
| 4,395,980 | 8/1983 | Tominaga et al. | 123/90.31 |
| 4,553,509 | 11/1985 | Mezger et al. | 123/90.27 |
| 4,633,826 | 1/1987 | Tominaga et al. | 123/90.31 |
| 4,729,348 | 3/1988 | Okada et al. | 123/90.27 |
| 4,753,199 | 6/1988 | Melde-Tuczai et al. | 123/90.31 |
| 4,776,307 | 10/1988 | Ruf et al. | 123/90.31 |

FOREIGN PATENT DOCUMENTS

| | | | |
|---|---|---|---|
| 0112494 | 11/1983 | European Pat. Off. . | |
| 0245791 | 5/1987 | European Pat. Off. . | |
| 2059220 | 5/1971 | France . | |
| 0210110 | 12/1982 | Japan | 123/90.31 |
| 0015612 | 1/1984 | Japan | 123/90.27 |

*Primary Examiner*—Willis R. Wolfe
*Assistant Examiner*—Weilun Lo
*Attorney, Agent, or Firm*—Evenson, Wands, Edwards, Lenahan & McKeown

[57] ABSTRACT

For actuating the inlet and outlet valves, two parallel overhead camshafts respectively are assigned to the two cylinder banks of a multi-cylinder V-engine and are driven by an intermediate timing gear by means of chain drives. The intermediate timing gear is driven by the crankshaft by means of gear wheels. The camshaft drive is arranged between the end bearing of the crankshaft and the flywheel.

6 Claims, 3 Drawing Sheets

CAMSHAFT DRIVE OF A MULTI-CYLINDER V-ENGINE

BACKGROUND AND SUMMARY OF THE INVENTION

The invention relates to a camshaft drive of a multi-cylinder V-engine of the type where the valves are actuated by two camshafts respectively which are assigned to a cylinder bank, said camshafts being disposed overhead and being driven by the crankshaft by way of an intermediate timing gear.

From the U.S. Pat. No. 3,110,195, a camshaft drive for a V-engine is known in which an intermediate timing gear engaging in a crankshaft gear wheel drives one camshaft by way of another gear drive which, in turn drives the second camshaft also by means of gears. Because of the high noise emission, this type of a camshaft drive, at most, can be used for racing engines but is unsuitable for production cars.

It is an object of the invention to provide a compact camshaft drive which requires little space, causes less noise and contributes to the damping of torsional vibrations originating from the crankshaft and the camshafts.

According to preferred embodiments of the invention, this object is achieved by providing an arrangement wherein the camshaft drive is arranged close to an engine flywheel at an output end of the crankshaft, and wherein the intermediate timing gear has a gear wheel mating with a crankshaft gear wheel as well as two sprocket wheels by means of which, in each case, the two camshafts of one cylinder bank are driven by means of a chain. Since a chain drive is used for driving the camshafts from the direction of the intermediate timing gear, the transmission line becomes noticeably quieter and contributes to the damping of vibrations. The reason is that the chains have a certain elasticity in contrast to the rigid gears and are therefore able to dampen the amplitudes of the vibrations introduced into them. If the camshaft drive is arranged close to the flywheel on the output end of the crankshaft, it is situated at a point of the crankshaft which has particularly low vibrations so that a long service life and a lower noise level are ensured even at the highest engine speeds.

Reference is also made to related commonly assigned U.S. patent application Ser. No. 07/546,882, filed Jul. 2, 1990, (based on German application P 39 21 715.9, filed Jul. 1, 1989.

Other objects, advantages and novel features of the present invention will become apparent from the following detailed description of the invention when considered in conjunction with the accompanying drawings.

DETAILED DESCRIPTION OF THE DRAWINGS

Figure 1:
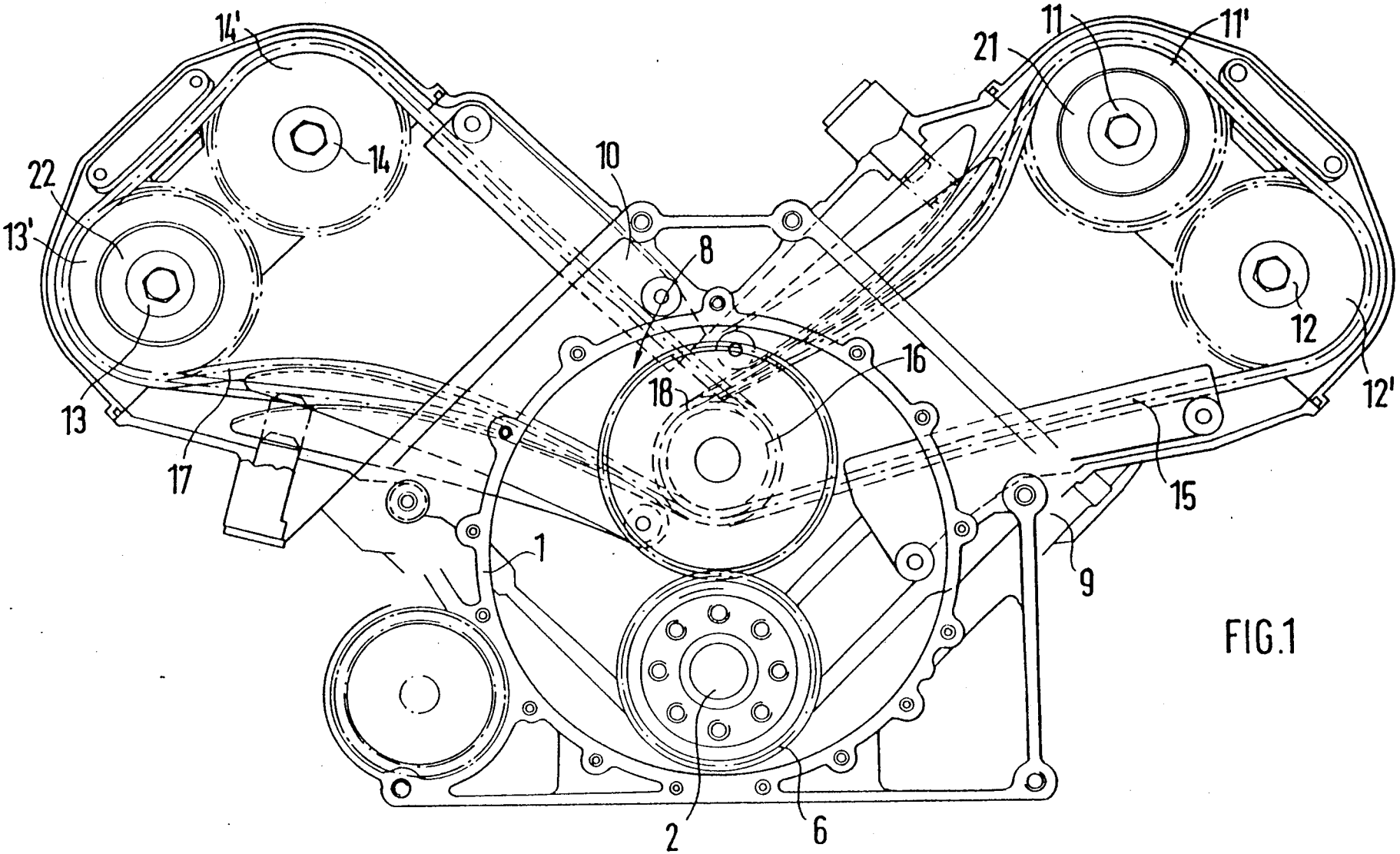
FIG. 1 is a schematic cross-sectional view of a piston internal-combustion engine having a camshaft drive constructed according to a preferred embodiment of the invention.
Figure 2:
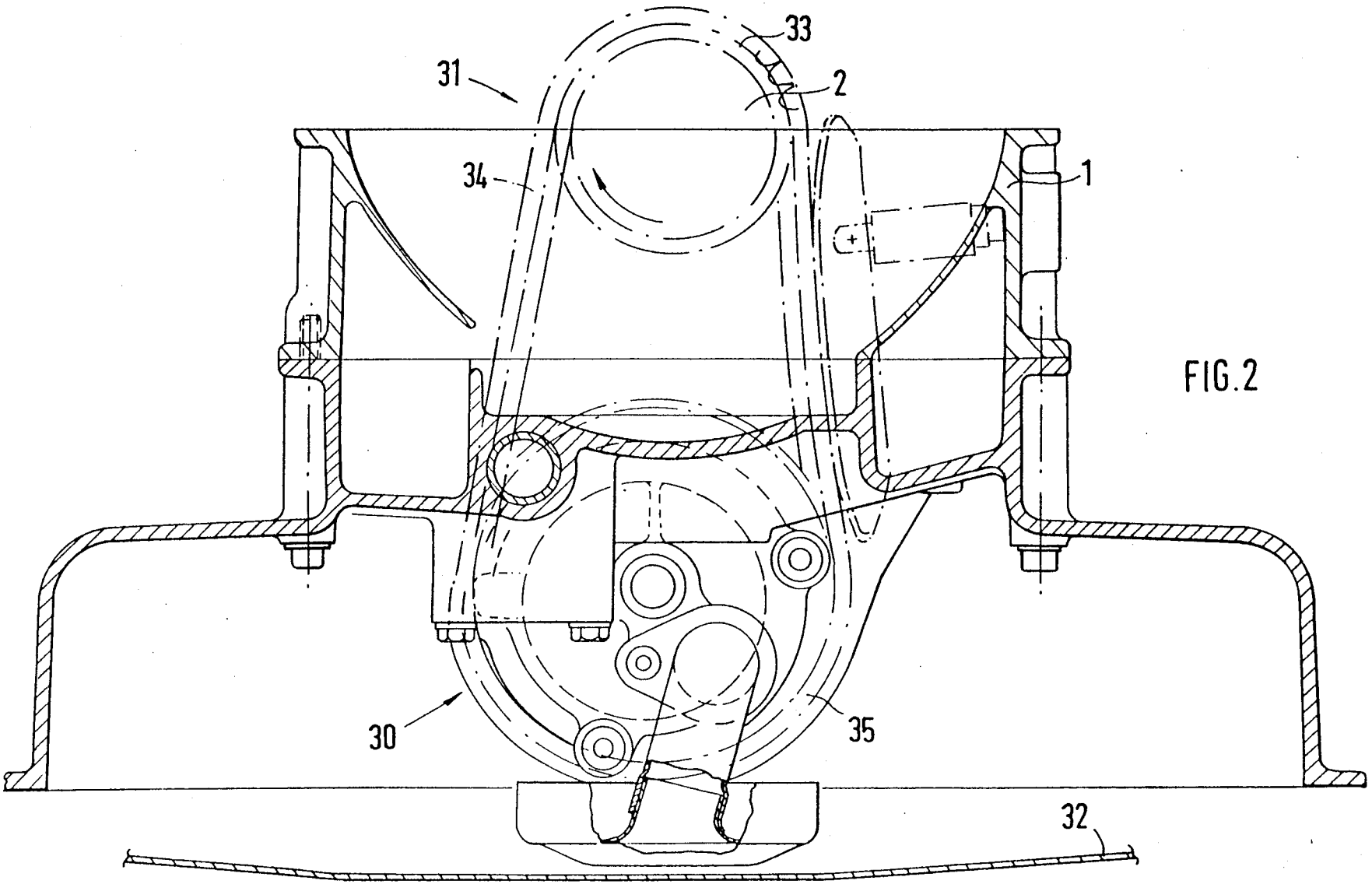
FIG. 2 is a schematic sectional view of an oil pump drive of a piston internal-combustion engine constructed according to FIG. 1.
Figure 3:
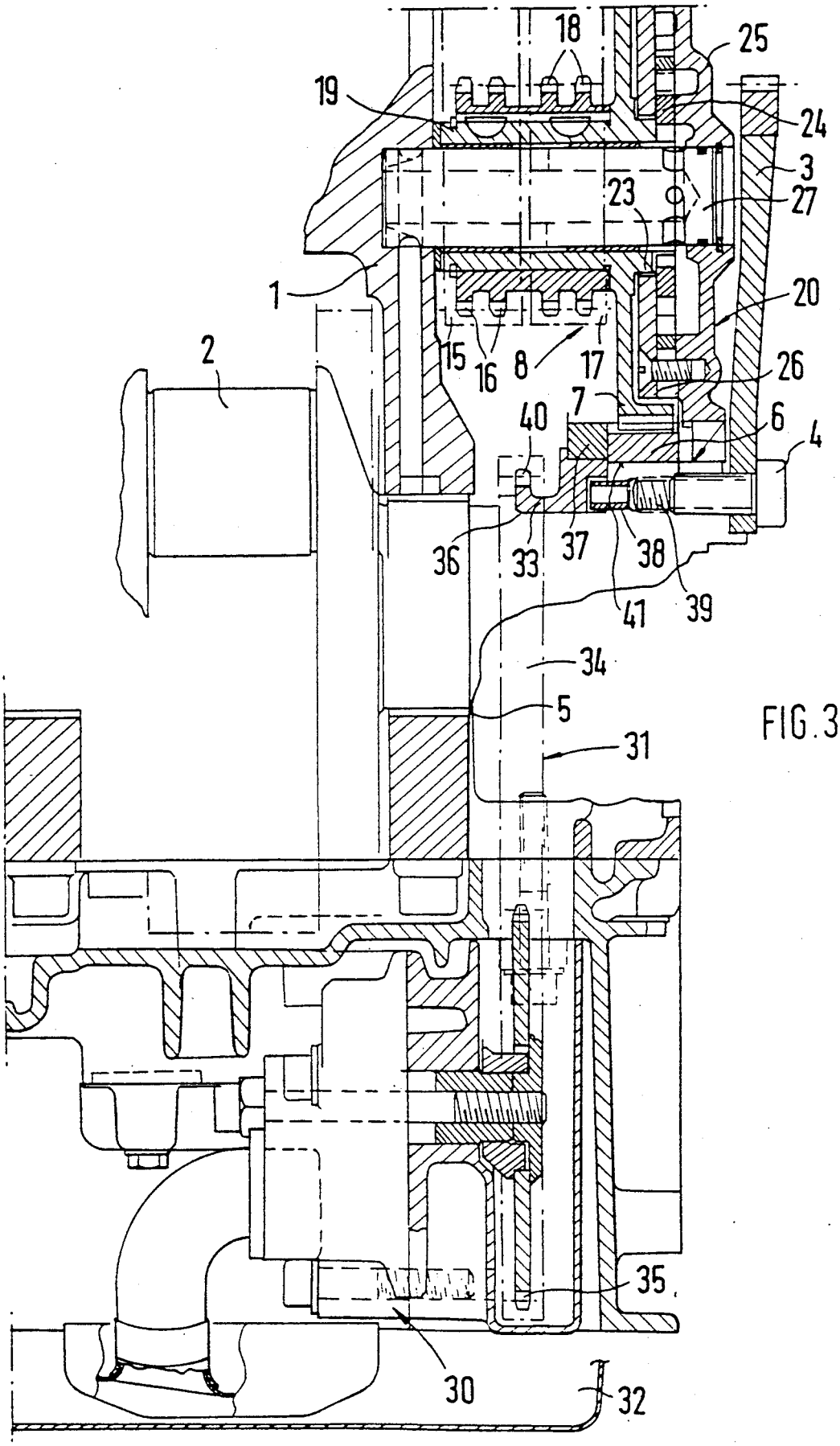
FIG. 3 is a longitudinal sectional view of the camshaft drive and the oil pump drive according to FIG. 1 and FIG. 2.

On a crankshaft 2 of an 8-cylinder V-engine disposed in a crankcase 1, a flywheel 3 is bolted to the output end face by means of several bolts 4. A camshaft drive originating from the crankshaft 2 is arranged between the flywheel 3 and the end bearing 5. The camshaft drive comprises a gear wheel 7 of an intermediate timing gear 8 mating with a crankshaft gear wheel 6 and two chain drives driven by the intermediate timing gear 8 and leading to the four camshafts 11, 12, 13, 14 assigned to the two cylinder banks 9, 10 and each carrying one double sprocket wheel 11', 12', 13', 14'. Double sprocket wheels 11', 12' are driven by a double sprocket wheel 16 by means of a double roller chain 15 and double sprocket wheels 13', 14' are driven by a double sprocket wheel 18 by means of a double roller chain 17. Double sprocket wheels 16, 18 are constructed in one piece and are fastened on the hub sleeve 19 of the gear wheel 7.

At the other end face of the gear wheel 7, an oil pump 20 is arranged which supplies hydraulic rotating devices 21, 22 at the camshafts 11, 13 with hydraulic pressure. By means of the rotating devices, the rotating position is changed between the camshafts 11, 13 and the sprocket wheels 11', 13' assigned to them. A pump wheel 24 is fastened on a hollow hub 23 of the gear wheel 7. The oil pump 20 is covered by means of a pump cover 25 which, together with a cover disk 26 screwed to it, forms the pump housing. In the pump cover 25, a bearing sleeve 27 is fastened on which the intermediate timing gear 8 is disposed and through which the oil supply takes place to the oil pump 20.

Since the gear wheel transmission from the crankshaft 2 to the intermediate timing gear 8 has a ratio of 1:2, but the chain sprocket transmission from the intermediate timing gear 8 to the camshafts 11, 12, 13, 14 is 1:1, the camshafts 11, 12, 13, 14 rotate at half the crankshaft speed.

The main oil pump 30 is driven by the crankshaft 2 by means of a chain drive 31. It takes in lubricating oil from the oil pan 32 and, with a pressure of approximately 3 bar, pumps it to the bearing points of the internal-combustion engine which are to be lubricated. A partial flow of this oil, by way of the central bore of the bearing sleeve 27, reaches the oil pump 20 which increases the oil pressure to approximately 8 bar and feeds it to the hydraulic camshaft rotating devices 21. Since this hydraulic pressure is very high, the camshaft rotating devices 21 may be constructed with a desirably small volume.

The chain drive 31 is formed by a sprocket wheel 33 fastened on the crankshaft 2, a chain 34 and a sprocket wheel 35 fastened to the main oil pump 30. The sprocket wheel 33 is comprised of two half shells which were formed by the radial separation of a cylindrical sprocket wheel hub. In a groove 36 of the crankshaft 2, the two half shells of the sprocket wheel 33 are joined again at their breaking point and are held axially. A retaining ring 37 pulled onto the sprocket wheel 33 holds the two half shells radially together. The sprocket wheel 33 is locked in the circumferential direction by means of a fitting sleeve 38 which is fixed in the crankshaft and which, during the mounting, was fitted through a bore 39 of the flywheel which is aligned with it. The gear ring 40 of the sprocket wheel 33 and thus the whole chain drive 31 is disposed in the center between the two double sprocket wheels 16, 18 of the camshaft drive.

For the mounting, the crankshaft gear wheel 6 is pushed over the smoothly turned surface area 41 of the crankshaft 2 until it rests against the retaining ring 37. At this seat, it is shrunk onto the crankshaft 2.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A camshaft drive for a multi-cylinder V-engine of the type where the valves are actuated by two camshafts respectively which are assigned to a cylinder bank, said camshafts being disposed overhead and being driven by the crankshaft by way of an intermediate timing gear wherein the camshaft drive is arranged close to an engine flywheel at an output end of the crankshaft, and wherein the intermediate timing gear has a gear wheel mating with a crankshaft gear wheel as well as two sprocket wheels, by means of which, in each case, the two camshafts of one cylinder bank are driven by means of a chain.

2. A camshaft drive according to claim 1, wherein the camshafts, of both cylinder banks which actuate the inlet valves can be adjusted in their relative position by means of a hydraulic rotating device, and wherein the rotating device receives hydraulic pressure from an oil pump which is arranged coaxially at the intermediate timing gear, is integrated into its outer contour and is driven by it.

3. A camshaft drive according to claim 2, wherein the sprocket wheels are fastened on the end face of the gear wheel on its hub sleeve, and wherein a pump wheel of the oil pump is fastened on the other end face of the gear wheel on its hollow hub.

4. A camshaft drive according to claim 1, wherein that the intermediate timing gear is disposed on a bearing sleeve which is fastened in a sealed manner in the pump cover mounted on the crankcase.

5. A camshaft drive according to claim 1, wherein the sprocket wheels are designed as double sprocket wheels 16, 18 and drive the camshafts by means of double roller chains.

6. A camshaft drive according to claim 1, wherein the gear wheel transmission ratio from the crankshaft to the intermediate timing gear is 1:2.

* * * * *